US006132192A

United States Patent [19]

Mitsunaga et al.

[11] Patent Number: 6,132,192

[45] Date of Patent: Oct. 17, 2000

[54] SCROLL COMPRESSOR MADE OF SILICON CONTAINING ALUMINUM ALLOY

[75] Inventors: Toshihiko Mitsunaga, Saitama; Kazuya Sato, Gunma; Kazuyoshi Sugimoto, Gunma; Kazuaki Fujiwara, Gunma, all of Japan

[73] Assignee: Sanyo Electric Co., Ltd., Osaka, Japan

[21] Appl. No.: 08/938,608

[22] Filed: Sep. 26, 1997

[30] Foreign Application Priority Data

Sep. 27, 1996 [JP] Japan ..... 8-257078

[51] Int. Cl.[7] ..... F01C 1/02

[52] U.S. Cl. ..... 418/55.2

[58] Field of Search ..... 418/55.2, 179

[56] References Cited

U.S. PATENT DOCUMENTS 5,125,810 6/1992 Suefuji et al. ..... 418/55.2
5,478,220 12/1995 Kamitsuma et al. ..... 418/55.2
5,548,973 8/1996 Komine et al. ..... 62/469
5,584,678 12/1996 Hirooka et al. ..... 418/55.2
5,775,892 7/1998 Miyasaka et al. ..... 418/55.2

FOREIGN PATENT DOCUMENTS 365832 12/1992 Japan .

*Primary Examiner*—Charles G. Freay
*Attorney, Agent, or Firm*—Armstrong, Westerman, Hattori, McLeland & Naughton

[57] ABSTRACT

An orbiting scroll 2 is made of an alloy having a composition of 8–10% by weight of silicon, 2–5% by weight of copper, 0.5–0.8% by weight of magnesium, and remaining percentage of aluminum. The key slots 9 of the orbiting scroll 2 are coated with a layer of hard alumite impregnated by molybdenum disulfide to thereby provide the orbiting scroll 2 with sufficient mechanical strength to stand severe operating conditions and to drastically decrease the frictional abrasion of the key slots.

4 Claims, 3 Drawing Sheets

SCROLL COMPRESSOR MADE OF SILICON CONTAINING ALUMINUM ALLOY

FIELD OF THE INVENTION

The invention relates to a scroll compressor, and more particularly, to a scroll compressor whose movable elements have high strength and are free of fracture.

BACKGROUND OF THE INVENTION

A typical scroll compressor has a fixed scroll which is secured to a frame of the compressor and an orbiting scroll which is operably coupled with the fixed scroll with its rotational axis offset from the center of the fixed scroll. The scrolls have respective spiral laps so as to form a space for compressing refrigerant gas which is sucked in the space by the orbiting scroll as the orbiting scroll is rotated about the fixed scroll.

An Oldham coupling is used to suppress the rotation of the orbiting scroll on its axis so that the orbiting scroll revolves about the fixed scroll. The Oldham coupling, placed between the lower face of the orbiting scroll and the upper face of the frame, has on the upper face thereof a set of two keys and on the lower face thereof another set of two keys. The upper keys are slidably engaged in two key slots formed on the lower face of the orbiting scroll, while the lower keys are each slidably engaged in corresponding ones of two key slots formed on the upper face of the frame. Further, the upper face of the Oldham coupling slidably abuts on the lower face of the orbiting scroll, and the lower face of the Oldham coupling abuts on the upper face of the frame. During a compression operation of the scroll compressor, the Oldham coupling undergoes a rotational motion relative to the orbiting scroll and maintains the revolution of the orbiting scroll around the fixed scroll.

Most orbiting and fixed scrolls are made of an aluminum—silicon (Al—Si) alloy. Al—Si alloys have been widely used for these types of scrolls since they have superb anti-corrosion and abrasion resistance along with low thermal expansion coefficients. Unfortunately, however, the alloys do not have sufficient mechanical strength for the scrolls. In addition, Al—Si alloys have rather poor abrasion resistance when they are in frictional contact with other elements made of iron. This is the case for the orbiting scroll made of an Al—Si alloy in slidable engagement with an iron Oldham coupling.

In view of recent developments in the field of air conditioners and refrigeration apparatuses, there is accordingly a need for an improved Al—Si alloy suitable for a durable orbiting scroll that can work well with the Oldham coupling.

It is therefore an object of the invention to provide a scroll compressor having a orbiting scroll with sufficient mechanical strength against severe conditions imposed on the orbiting scroll during the operation, and having excellent abrasion resistance against the Oldham coupling.

SUMMARY OF THE INVENTION

There is provided, in accordance with the present invention, a scroll compressor comprising:

a frame having a couple of key slots on the upper end thereof;

a fixed scroll having a spiral lap and positioned above said frame and spaced apart at a distance from said frame;

a orbiting scroll opposed to said fixed scroll and having a spiral lap engaged with said spiral lap of said fixed scroll, and a couple of key slots on the lower face thereof, said lower face slidably abutting against the upper face of said frame;

an annular Oldham coupling configured to surround said abutting faces, and having on the upper end thereof keys which are slidably engaged with said key slots of said orbiting scroll, and on the lower end thereof keys which are slidably engaged with said key slots of said frame, wherein at least one of said fixed and orbiting scrolls is made of an alloy having a composition of 8–10% by weight of silicon, 2–5% by weight of copper, 0.5–0.8% by weight of magnesium, and remaining percentage by weight of aluminum.

With this structure, at least one of the scrolls may have sufficient material strength to stand severe operating conditions, and have a large fatigue limit.

The orbiting scroll may be coated with a hard alumite layer impregnated with molybdenum disulfide. Accordingly, the orbiting scroll may have very large abrasion resistance, and hence excellent durability.

The Oldham coupling may be made of an alloy composed by weight of 8–10% of silicon, 2–5% of copper, 0.5–0.8% of magnesium, and remaining percentage of aluminum. This Oldham coupling also acquires the same material strength as the orbiting scroll, so that it may prevent the fracture of itself, and enhance the reliability of the scroll compressor.

At least upper keys of the Oldham coupling or at least key slots of the orbiting scroll may be coated with a hard alumite layer impregnated with molybdenum disulfide, so that frictional abrasion that might take place with the keys and the key slots will be greatly reduced and ensure prolonged life of the scroll compressor.

BRIEF DESCRIPTION OF THE DRAWINGS

Preferred embodiments of the invention will now be described in conjunction with the accompanying drawings, in which.

DETAILED DESCRIPTION OF THE PREFERRED EMBODIMENT

Figure 1A:
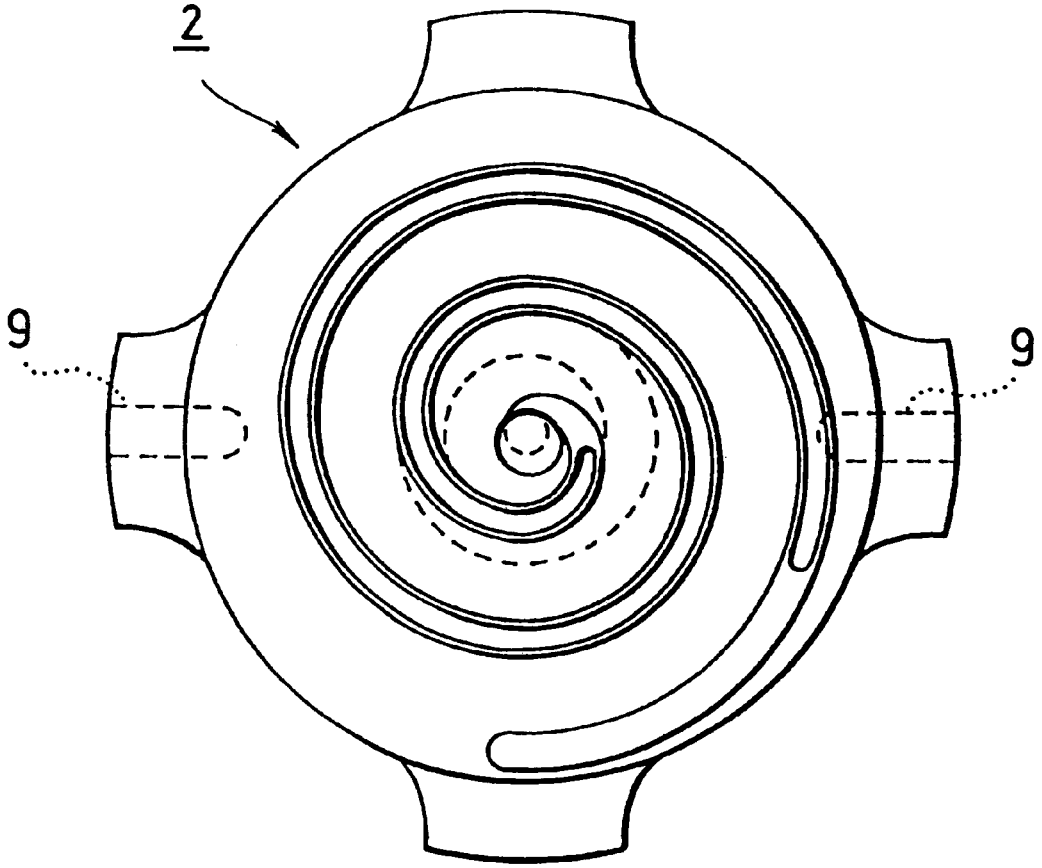
FIGS. 1(*a*) and 1(*b*) are a plan view and a cross section, respectively, of an orbiting scroll embodying the invention.
Figure 1B:
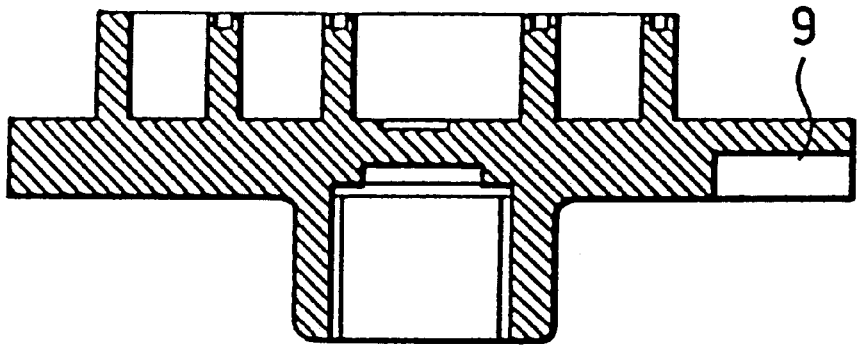
Figure 2:
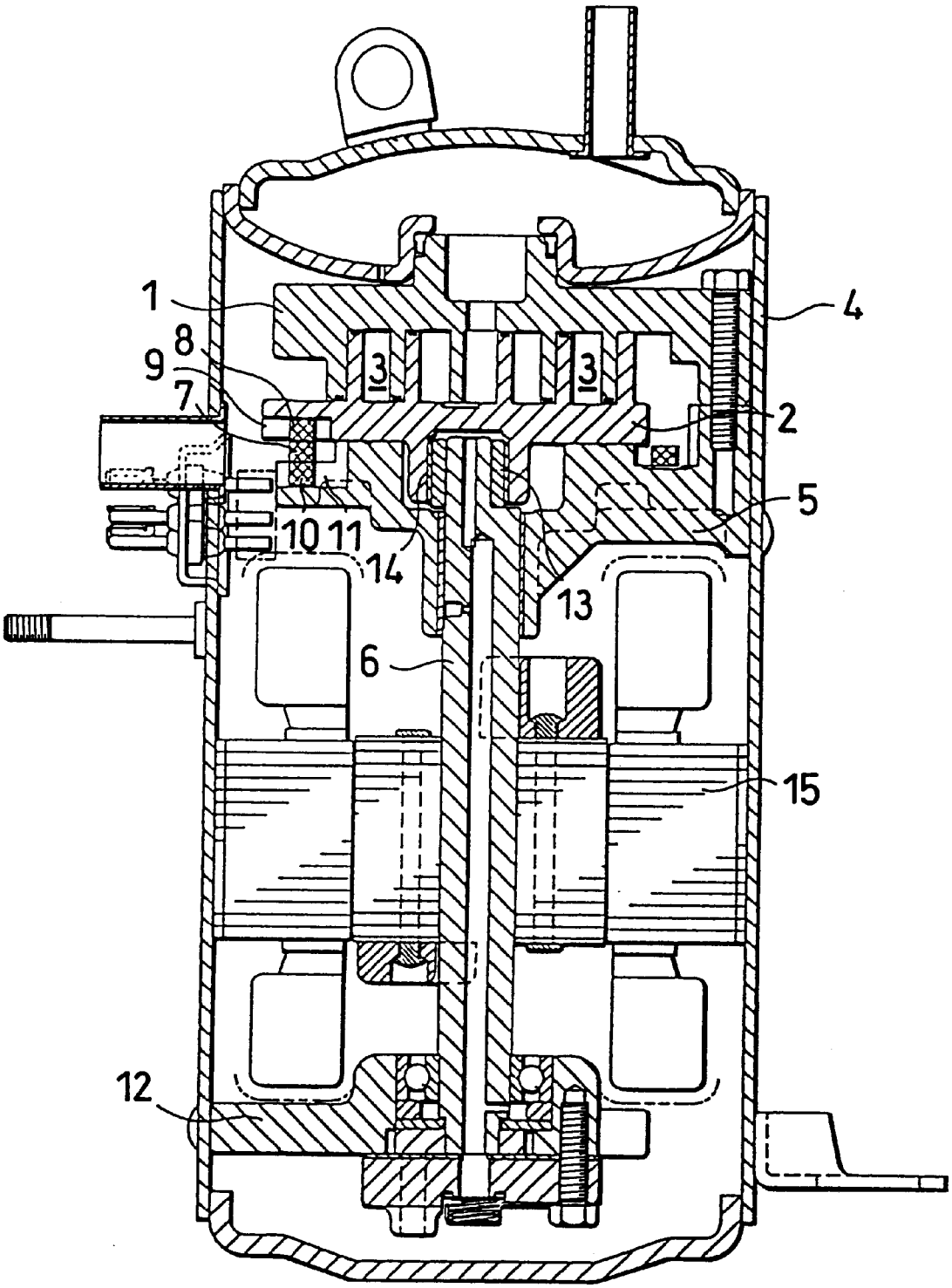
FIG. 2 is a cross section of a scroll compressor according to the invention.

Referring now to FIG. 2, there is shown a scroll compressor according to the invention. The scroll compressor comprises a case 4, a frame 5 fixed on the case 4, a fixed scroll 1 fixed on the frame 5 at a given distance from the frame 5, and a orbiting scroll 2 (FIG. 1). The fixed scroll 1 and the orbiting scroll 2 are each provided with a spiral lap, and coupled together at a mutually offset position so as to form a space between them for compressing the refrigerant gas trapped in the space. The orbiting scroll 2 is mounted on a shaft 6 passing through the center of the case 4 such that the lower surface thereof abuts on the frame 5.

Mounted on the orbiting scroll 2 is an Oldham coupling 7. The Oldham coupling 7 converts the rotational motion of the shaft 6 to the revolving motion of the orbiting scroll 2 about the shaft. The Oldham coupling 7 has a generally annular configuration to surround the lower face of the orbiting scroll 2 in slidable abutment on the upper face of the Oldham coupling 7, and the upper face of the frame 5 that is also in slidable abutment with the lower face of the Oldham coupling. The upper face of the Oldham coupling 7 has a set of two keys 8 (only one of them is shown in FIG. 2), each of which engages in a corresponding one of two key slots 9 formed in the lower surface of the orbiting scroll 2. On the other hand, the lower surface of the Oldham coupling 7 has another set of two keys 10 (only one of them is shown in FIG. 2), each of which engages in a corresponding one of two key slots 11 formed in the upper surface of the frame 5. Accordingly, as the shaft 6 is rotated, the Oldham coupling 7 and the orbiting scroll 2 undergo relative motion such that the orbiting scroll 2 revolves around the shaft.

The shaft 6 is rotatably supported at the upper face thereof by the frame 5 and at the lower face thereof by a bearing plate 12. Mounted on the upper face of the shaft 6 is a crank shaft 13, which is inserted in a shaft engagement section 14 of the orbiting scroll 2. The shaft 6 is operably connected with a motor 15 for rotating the shaft 6.

In the example shown herein, the fixed scroll 1 and the orbiting scroll 2 are made of an alloy having a composition listed in Table 1 below in accordance with the invention.

TABLE 1

| CHEMICAL COMPOSITION (percentage by weight) | | | |
|---|---|---|---|
| SILICON | COPPER | MAGNESIUM | ALUMINUM |
| 8–10 | 2–5 | 0.5–0.8 | remaining |

The composition shown in Table 1 is determined from the point of improvement of not only mechanical strength of the scrolls but also the abrasion resistance, machinability, and easiness of surface treatment (the easiness of surface treatment will be hereinafter referred to as surface treatability). It should be noted that 8–10% of silicon is inevitable to increase mechanical strength, especially fatigue strength at high temperature. It should be also noted that if the percentage of silicon is too much, the machinability lowers and the surface treatment becomes harder in the subsequent manufacturing processes. Thus, a recommended maximum percentage of silicon is 10%.

Copper, added to increase the machinability and the fatigue strength at high temperature, is necessary at least 2 percent for this purpose but should not exceed 5 percent. At least 0.5 percent of magnesium is added to increase the mechanical strength of the alloy, but it should not be more than 0.8 percent, otherwise the alloy will lose its machinability to a level lower than that of conventional Al—Si alloys.

The mechanical strength of the alloy described above is compared with known Al—Si alloys in Table 2.

TABLE 2

| | TENSILE STRENGTH ($N/mm^2$) | ELONGATION (%) | HARDNESS (HRB) |
|---|---|---|---|
| This invention | 450–500 | 5–6 | 70–80 |
| 4032 (JIS Al—Si alloy) | 380 | 8 | 60 |
| S 30C carbon | 630 | 30 | 110 |

The orbiting scroll 2 is surface treated at least on the lower face thereof having the key slots 9 as shown in FIGS. 1(*a*) and (*b*). In the example shown herein, the surface is treated by impregnating it with molybdenum disulfide while the surface is subjected to oxidization to form an alumite layer on the surface. Such surface treatment will be referred to as alumite hardening treatment.

The hard alumite treatment is suited to increase abrasion resistance of the mechanical elements. A disadvantage associated with the hard alumite treatment is that the mechanical elements thus treated have poor initial fitting and are likely to be scratched. Microscopic particles of molybdenum disulfide, when distributed between two frictional surfaces, contribute to the reduction of the friction. Thus, the impregnation of molybdenum disulfide in the aluminum alloy greatly promotes reduction of the friction of the orbiting scroll 2.

In the scroll compressor described above, as the orbiting scroll 2 is revolved by the shaft 6, gaseous refrigerant of low pressure is continuously taken in the space 3 between the two scrolls 1 and 2. The refrigerant is gradually compressed to a hot and pressurized gas as it is forced towards the center of the space 3. The hot pressurized gas is discharged from the compressor through the fixed scroll 1.

The orbiting scroll 2 is exposed to a high stress every time it is subjected to such highly pressurized hot gas, resulting in material fatigue of the orbiting scroll 2. In general, any material may recover from such fatigue and does not fracture so long as the stress is within a fatigue limit. However, when the refrigerant gas is changed, for example, from one kind to another that does work at a high temperature and a high pressure, the refrigerant can cause a stress beyond the fatigue limit, since the fatigue limit under such conditions is low, so that the compressor may undergo fractures and may not be totally safe any longer.

For this reason, in a case where refrigerant gas R410A is used in a scroll compressor, it is preferable to make the fixed and the orbiting scrolls, 1 and 2, respectively, of Al—Si—Cu—Mg alloy, since the alloy has high mechanical strength. The mechanical strength of the alloy may be conveniently increased by increasing the Si content in the alloy, but at the same time abrasion resistance, machinability, and surface treatability must be also improved in order that the alloy is usable for the fixed and orbiting scrolls 1 and 2. It should be appreciated that the alloy shown in Table 1 may satisfy all these requirements.

Figure 3:
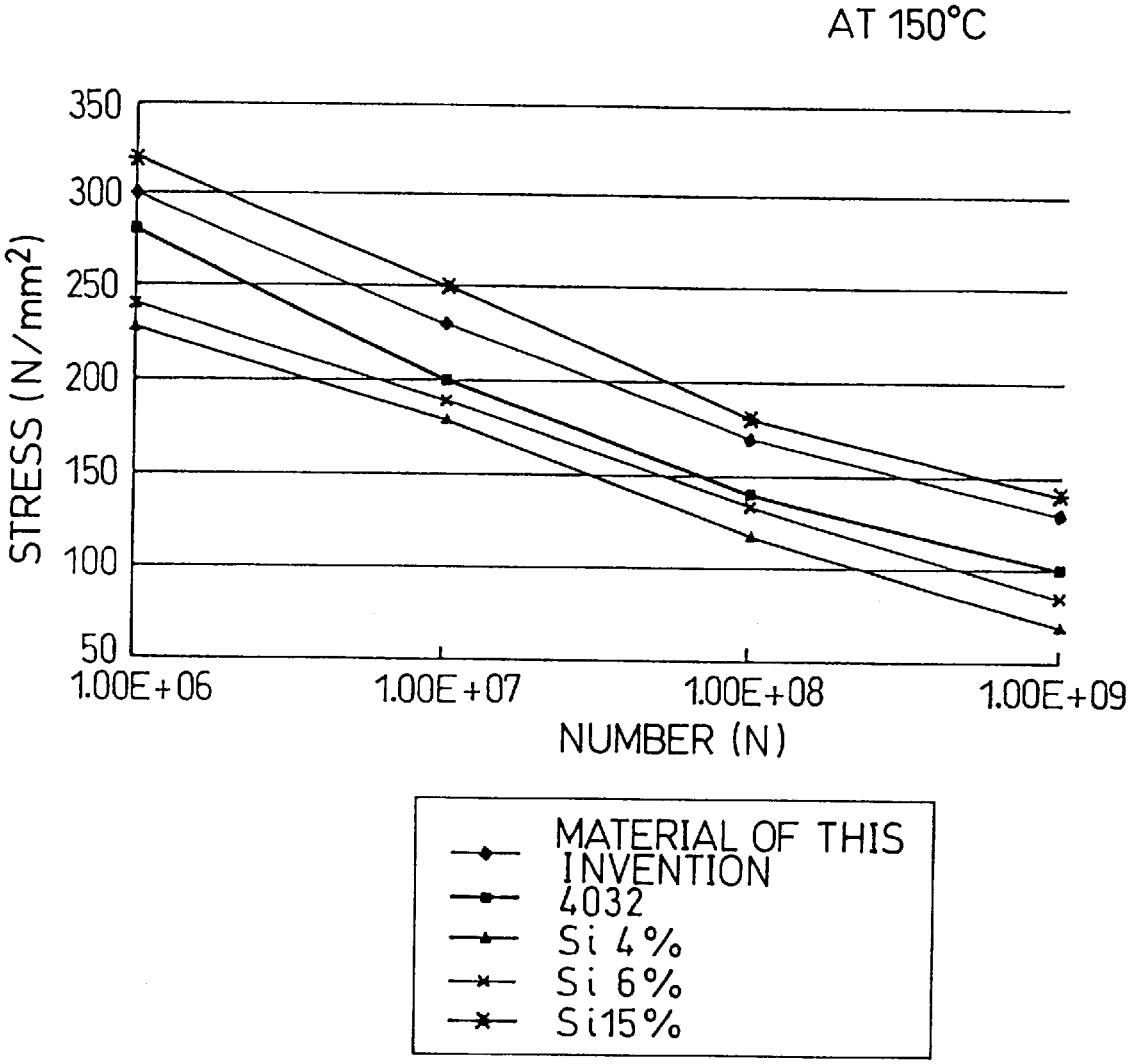
FIG. 3 is a graphical representation of fatigue strength of several Al—Si—Cu—Mg alloys at high temperatures.

FIG. 3 compares the Al—Si—Cu—Mg alloy according to the invention with known alloys. It is seen in the figure that an increase in Si content will add to the alloy more abrasion resistance at high temperature, but at a sacrifice of decrease in machinability and surface treatability. The loss of machinability and surface treatability arises due to the fact that during oxidization (that is, alumite hardening treatment) of the surface of a scroll, Si particles are not oxidized and results in pin holes. The alloy of Table 1 has a limited Si composition of at most 8% by weight, and has desirable abrasion resistance, machinability, and surface treatability.

It will be recalled that in order to harden the alumite layer of the key slots 9 of the orbiting scroll 2, they are impregnated with molybdenum disulfide during the alumite hardening treatment, which permits smooth movement of the keys 8 of the Oldham coupling 7 in the key slots 9, and hence reduces initial frictional abrasions thereof.

The hardened key slots 9 have a better fit for the keys 8 and much less frictional abrasion. It was observed in our experiments using a full scale model of the scroll compressor that the abrasion resistance of the key slots was increased by more than 50%.

In another embodiment of the invention, in addition to the fixed and the orbiting scrolls 1 and 2, respectively, the Oldham coupling 7 is also made of the Al—Si—Cu—Mg alloy. Since in addition to the keys 8, the Oldham coupling 7 has two more keys 10 on the lower face thereof in slidable engagement with the key slots 11 of the frame, it is preferable to harden at least the keys 8 and 10 by means of alumite hardening treatment and impregnate them with molybdenum disulfide. The details of the alumite hardening treatment and impregnation will not be described here again, since they are the same as for the key slots 9 discussed above.

It would be apparent that this embodiment has a further advantage over the first one since the high abrasion resistance, machinability, and surface treatability of the alloy will facilitate fabrication of the Oldham coupling and both the upper and lower keys of the Oldham coupling have less frictional abrasion and durability against thermal and mechanical stresses. In addition, the Oldham coupling shown herein is lighter in weight and hence has a smaller moment of inertia compared to conventional ones which are made of sintered iron. Hence, it is less likely that it produces undesirable noise and vibrations, which is highly desirable from practical point of view.

Although the presently preferred embodiment of the invention has been described, it will be understood that various changes may be made within the scope of the appended claims. For example, it is still possible to use the Al—Si—Cu—Mg alloy only for a major element, such as the orbiting scroll 2, which is exposed repeatedly to high stresses.

What is claimed is:

1. A scroll compressor comprising:

a frame having a couple of key slots on the upper end thereof;

a fixed scroll having a spiral lap and positioned above said frame and spaced apart at a distance from said frame;

an orbiting scroll opposed to said fixed scroll and having a spiral lap engaged with said spiral lap of said fixed scroll, and a couple of key slots on the lower face thereof, said lower face slidably abutting against the upper face of said frame; and an annular Oldham coupling having a configuration to surround said abutting faces, and having on the upper end thereof keys which are slidably engaged with said key slots of said orbiting scroll, and on the lower end thereof keys which are slidably engaged with said key slots of said a frame, wherein at least one of said fixed and orbiting scrolls is made of an alloy having a composition of 8–10% by weight of silicon, 2–5% by weight of copper, 0.5–0.8% by weight of magnesium, and remaining percentage by weight of aluminum.

2. The scroll compressor according to claim 1, wherein said orbiting scroll is coated with a hard alumite layer which is impregnated with molybdenum disulfide.

3. The scroll compressor according to claim 1, wherein said Oldham coupling is made of an alloy having a composition of 8–10% by weight of silicon, 2–5% by weight of copper, 0.5–0.8% by weight of magnesium, and remaining percentage by weight of aluminum.

4. The scroll compressor according to claim 3, wherein at least said key slots of said orbiting scroll or at least upper keys of said Oldham coupling is coated with a hard alumite layer which is impregnated with molybdenum disulfide.

* * * * *